US007004348B2

(12) United States Patent
Hong

(10) Patent No.: US 7,004,348 B2
(45) Date of Patent: Feb. 28, 2006

(54) PAINT TRAY

(76) Inventor: Thomas K. Hong, 1666 Queen Street East, Unit 18, Toronto, Ont. (CA) M4L 1G3

( * ) Notice: Subject to any disclaimer, the term of this patent is extended or adjusted under 35 U.S.C. 154(b) by 349 days.

(21) Appl. No.: 10/667,843

(22) Filed: Sep. 23, 2003

(65) Prior Publication Data

US 2004/0074908 A1 Apr. 22, 2004

Related U.S. Application Data

(60) Provisional application No. 60/417,910, filed on Oct. 7, 2002.

(51) Int. Cl.
*B05C 21/00* (2006.01)

(52) U.S. Cl. ..... 220/570; 220/495.02; 15/257.06

(58) Field of Classification Search ..... 220/570, 220/495.02, 495.01, 495.08, 495.09, 678, 220/23.9; D32/53.1; 15/257.06
See application file for complete search history.

(56) References Cited

U.S. PATENT DOCUMENTS

| | | | | |
|---|---|---|---|---|
| 3,514,012 | A * | 5/1970 | Martin | 220/570 |
| 3,757,990 | A * | 9/1973 | Buth | 220/570 |
| 4,765,123 | A * | 8/1988 | Caldwell | 53/459 |
| 2003/0074760 | A1 * | 4/2003 | Keller | 15/230.11 |
| 2004/0134917 | A1 * | 7/2004 | Carnegie | 220/570 |

* cited by examiner

*Primary Examiner*—Nathan J. Newhouse
*Assistant Examiner*—Eugene Lhymn

(57) ABSTRACT

A paint tray comprises a main body member having an interior surface and an exterior surface, and including a bottom floor, a right side wall, a left side wall, a pan end wall, and a reservoir end wall, wherein the right side wall, the left side wall, the pan end wall and the reservoir end wall each extend upwardly from the bottom floor to terminate in an upper edge. A plurality of apertures are disposed in the main body member. In use, tape is adhered to the exterior surface of the main body member at the plurality of apertures. A thin liner is placed onto the main body member at its interior surface so as to adhere to the adhesive surface of the tape at the plurality of apertures.

18 Claims, 12 Drawing Sheets

10

PAINT TRAY

This Patent Application claims priority from U.S. Provisional Patent Application No. 60/417,910, filed Oct. 7, 2002.

FIELD OF THE INVENTION

The present invention relates to paint can trays and more particularly to paint can trays that minimize waste and mess.

BACKGROUND OF THE INVENTION

Paint trays are commonly used as a reservoir for paint in conjunction with the use of paint rollers. Such paint trays provide a lowered reservoir at one end and have a downwardly sloped end portion leading to the reservoir. The roller is rolled along the pan portion to permit even "pick-up" of the paint by the paint roller.

Conventional paint trays must come, of course, be cleaned after each use, which is difficult and time consuming. Further, if oil based paints are used, it requires the use of chemicals, such as terpentine, which is undersirable.

U.S. Pat. No. 4,765,123 issued Aug. 23, 1988 to Caldwell, discloses a process for covering paint trays. A flexible, paint-impervious bag is placed over the entire paint tray. It is completely unattached to the paint tray and is simply slid on and slid off. Since it is not secured to the interior surface of the paint tray, any jostling of the bag could cause spillage of paint, and also would cause the bag to readily interfere with a paint roller.

It is an object of the present invention to preclude the need for cleaning a paint tray.

It is an object of the present invention to make it easy for returning excess to a paint can.

It is an object of the present invention to provide a improved paint tray that does not interfere with a paint roller while picking up paint.

SUMMARY OF THE INVENTION

In accordance with one aspect of the present invention there is disclosed a novel paint tray comprising a main body member having an interior surface and an exterior surface, and including a bottom floor, a right side wall, a left side wall, a front end wall, and a back end wall, wherein the right side wall, the left side wall, the front end wall and the back end wall each extend upwardly from the bottom floor to terminate in an upper edge. A plurality of apertures are disposed in at least one of the bottom floor, the right side wall, the left side wall, the front end wall and the back end wall. In use, tape having at least one adhesive surface is adhered to the exterior surface of the main body member at the plurality of apertures. A thin liner is placed onto the main body member at the interior surface of each of the bottom floor, the right side wall, the left side wall, the front end wall and the back end wall, so as to adhere to the adhesive surface of the tape at the plurality of apertures.

In accordance with another aspect of the present invention there is disclosed a novel method of preparing a paint tray to accept paint for subsequent use. The method comprises the steps of providing a paint tray having a plurality of apertures therein; adhering tape having at least one adhesive surface to the exterior surface of the paint tray at the plurality of apertures; and placing a thin liner onto the main body member at the interior surface of each of the bottom floor, the right side wall, the left side wall, the front end wall and the back end wall, so as to adhere to the adhesive surface of the tape at the plurality of apertures.

In accordance with yet another aspect of the present invention there is disclosed a novel pre-adhesived tray liner bag for use with a paint tray. The pre-adhesived tray liner bag comprises a tray liner bag having an outer surface that is to contact the interior upwardly facing surface of a paint tray, and at least one strip of double-sided adhesive backed tape disposed on the outer surface, with a layer of release paper adhered to the outer surface of the double-sided tape.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the paint tray according to the present invention, as to its structure, and use, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

Advantages, features and characteristics of the present invention, as well as functions of the related elements of the structure, and the combination of parts and economies of manufacture, will become more apparent upon consideration of the following detailed description with reference to the accompanying drawings.

DETAILED DESCRIPTION OF THE PREFERRED EMBODIMENTS

Figure 1:
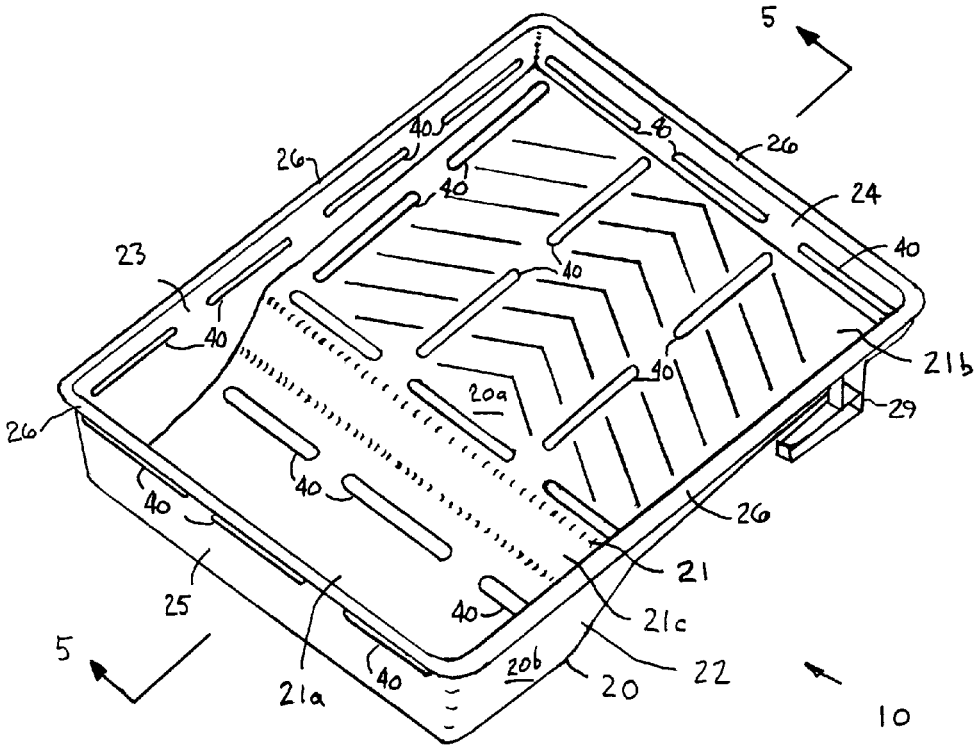
FIG. 1 is a perspective view from the reservoir end of a first preferred embodiment of the paint tray according to the present invention.
Figure 2:
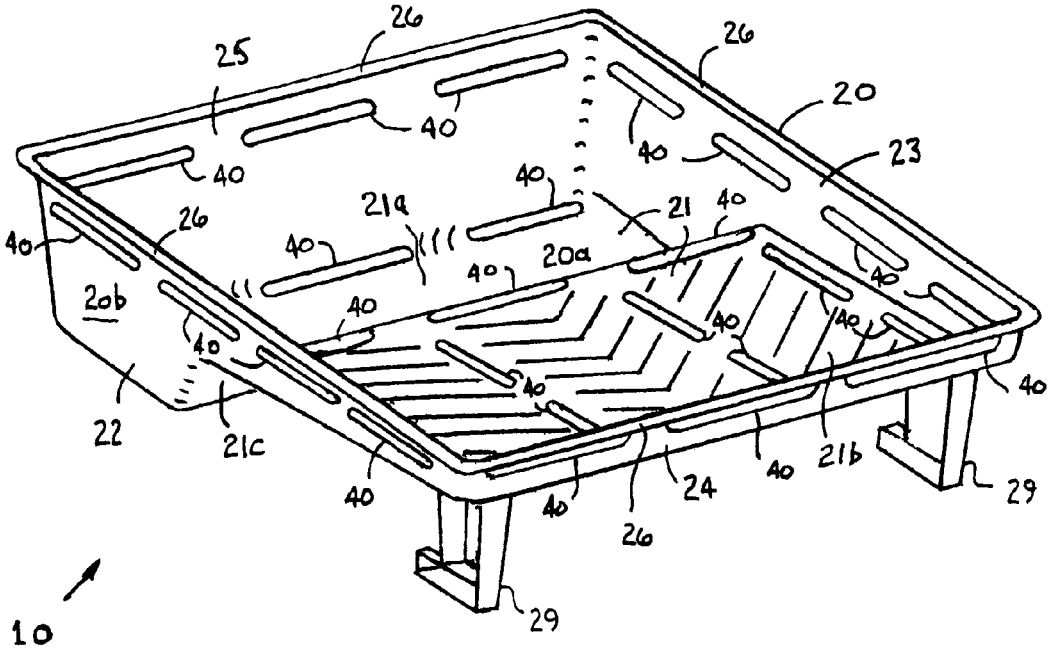
FIG. 2 is a perspective view from the pan end of the paint tray of FIG. 1.
Figure 3:
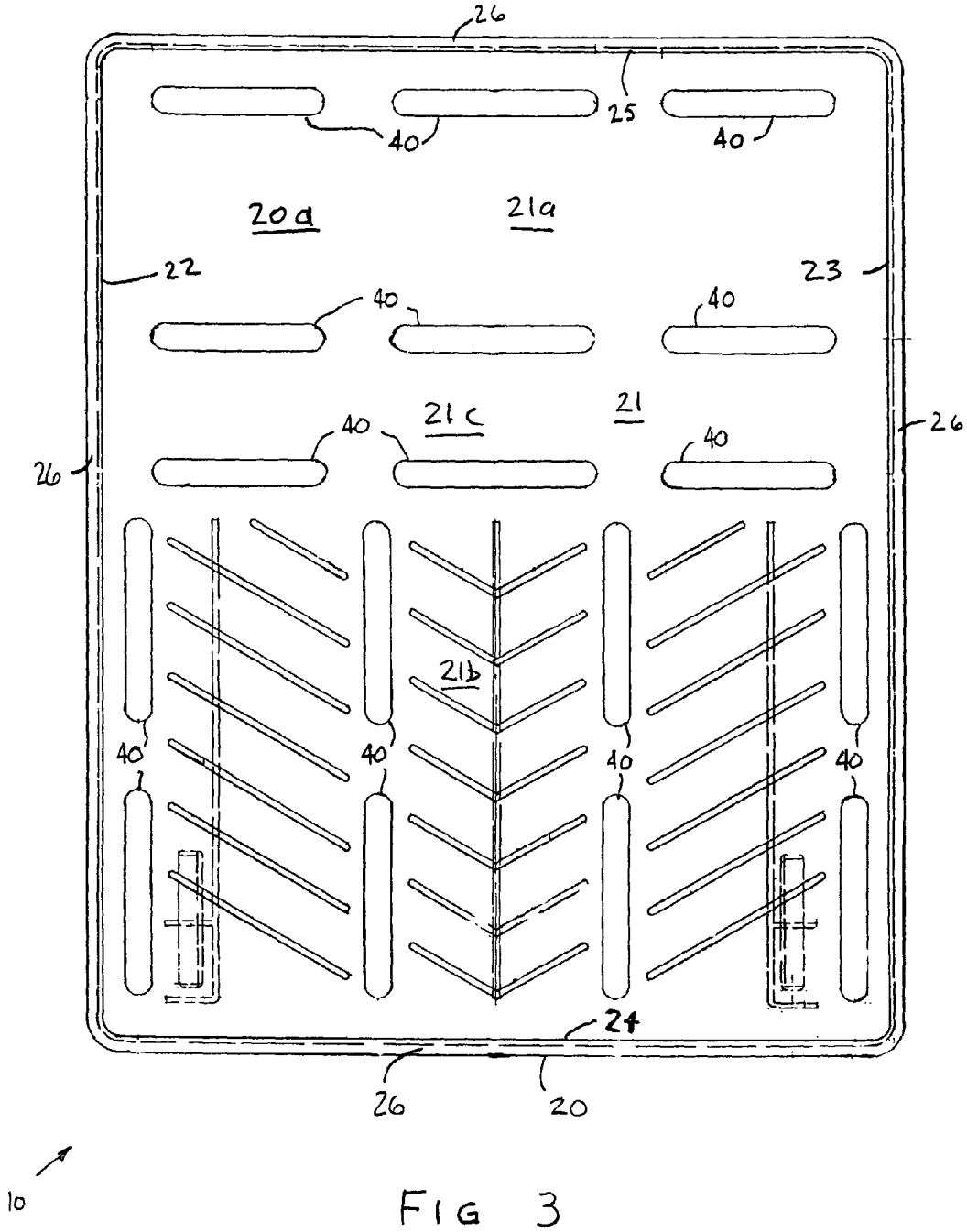
FIG. 3 is a top plan view of the paint tray of FIG. 1.
Figure 4:
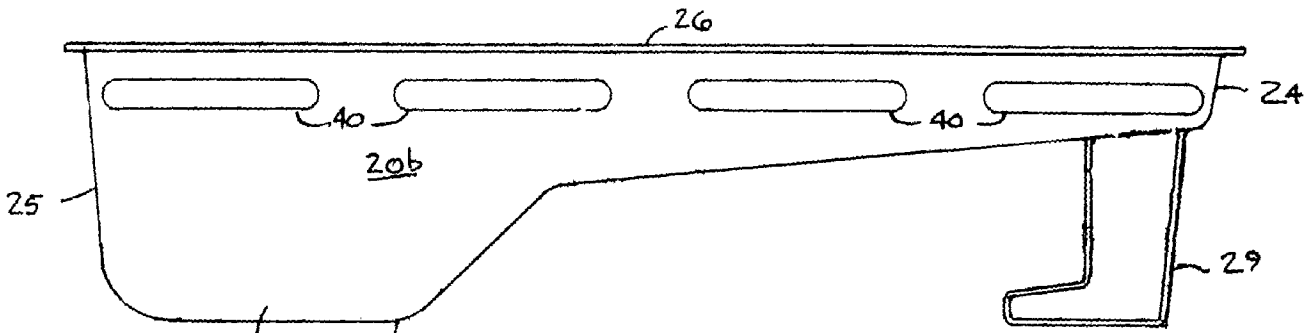
FIG. 4 is a side elevational view of the paint tray of FIG. 1.
Figure 5:
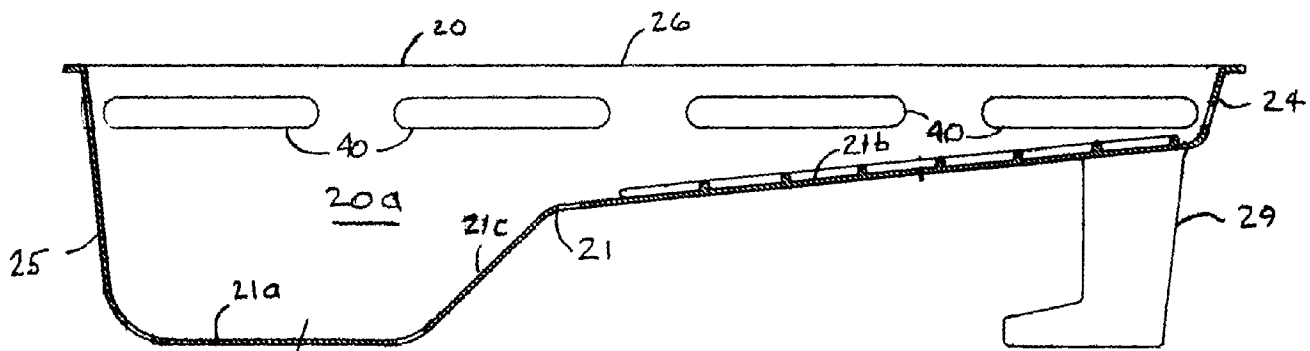
FIG. 5 is a cross-sectional side elevational view of the paint tray of FIG. 1, taken along section line A—A of FIG. 1.
Figure 6:
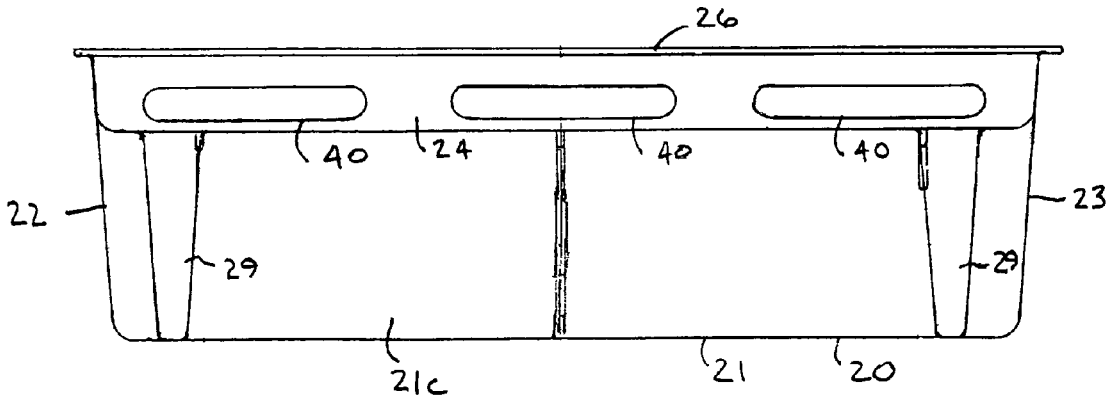
FIG. 6 is an end elevational view from the pan end of the paint tray of FIG. 1.
Figure 7:
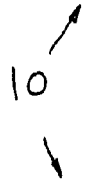
FIG. 7 is an end elevational view from the reservoir end of the paint tray of FIG. 1.
Figure 7:
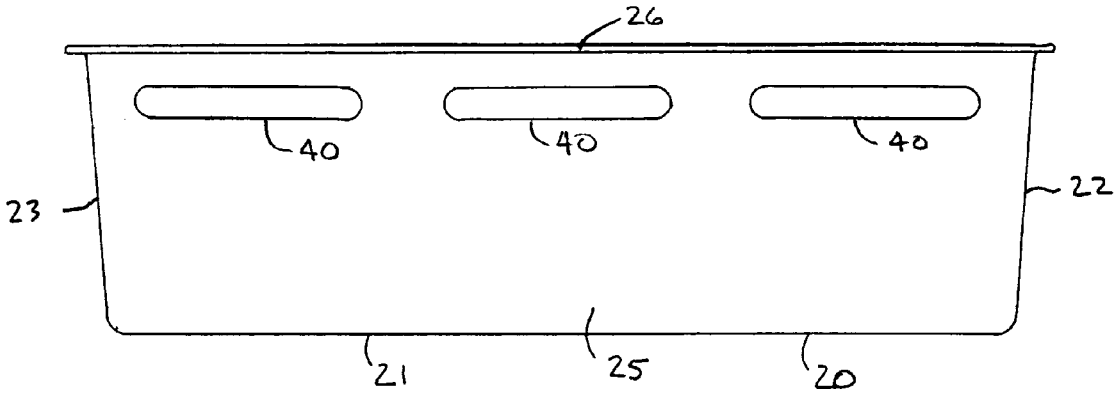
Figure 8:
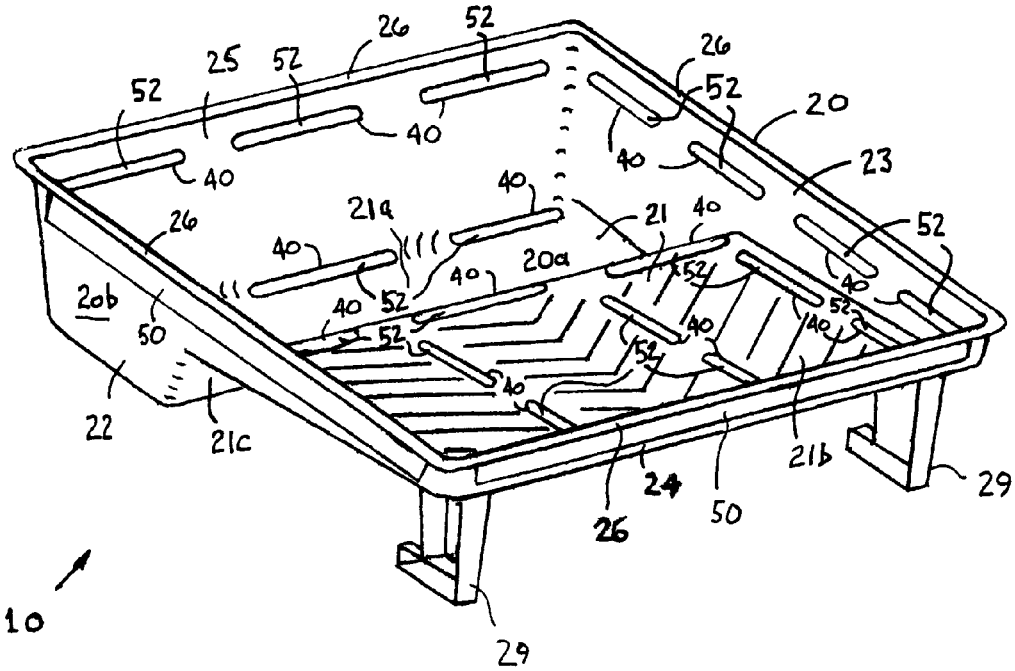
FIG. 8 is a perspective view similar to FIG. 2, but with adhesive backed tape secured thereon over the openings in the paint tray.
Figure 9:
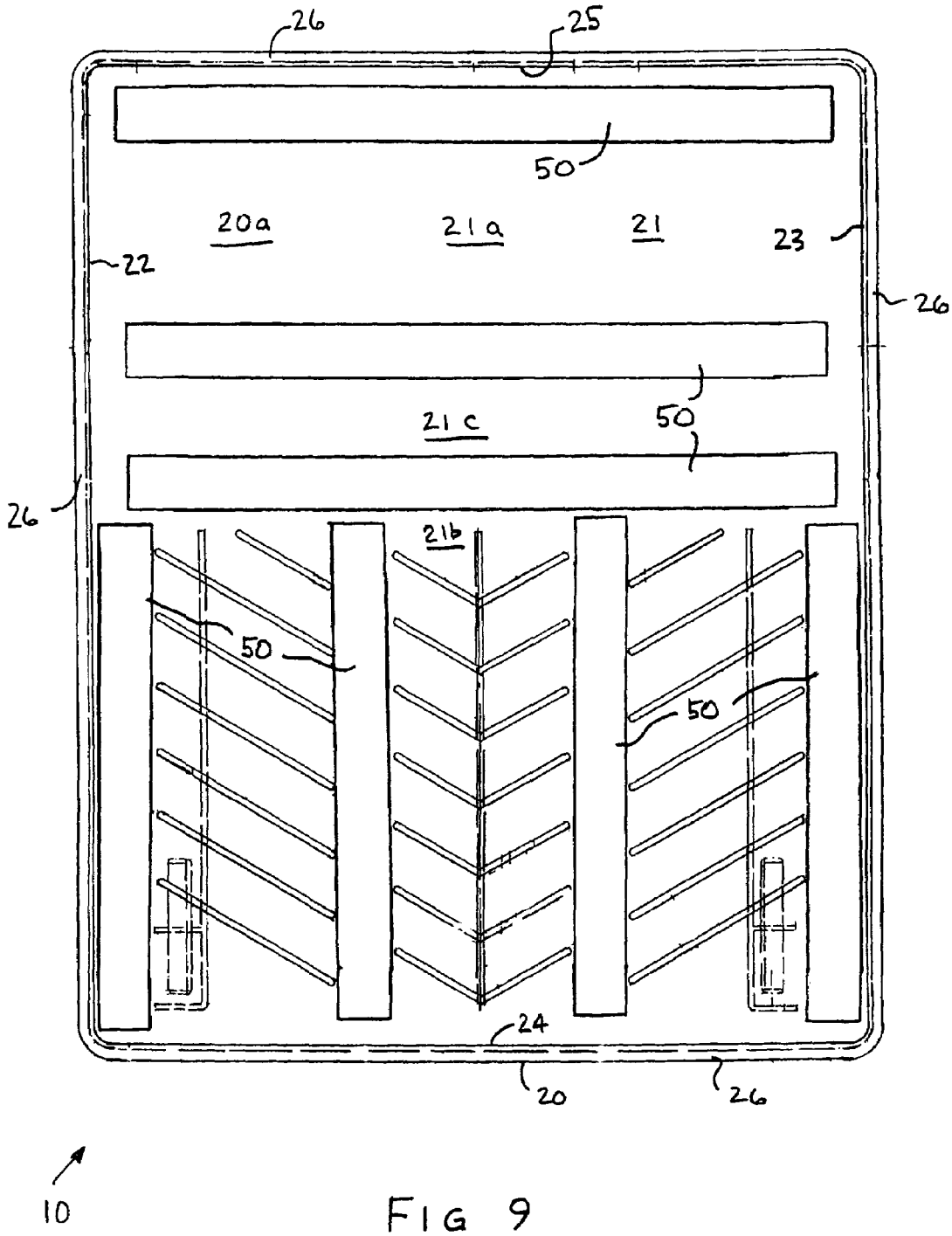
FIG. 9 is a top plan view similar to FIG. 3, but with adhesive backed tape secured thereon over the openings in the paint tray.
Figure 10:
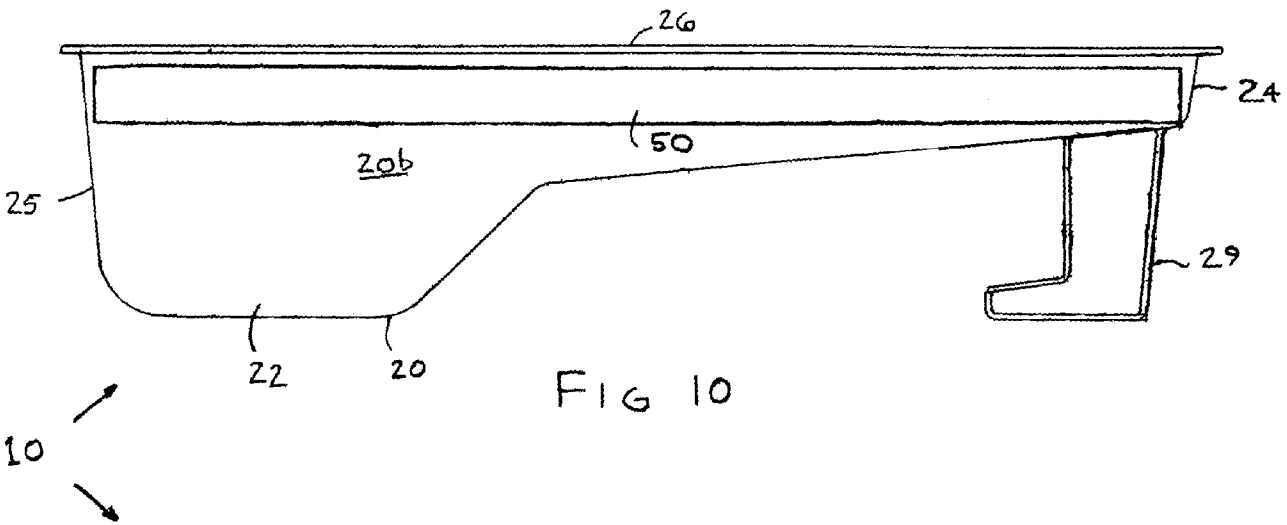
FIG. 10 is a side elevational view similar to FIG. 4, but with adhesive backed tape secured thereon over the openings in the paint tray.
Figure 11:
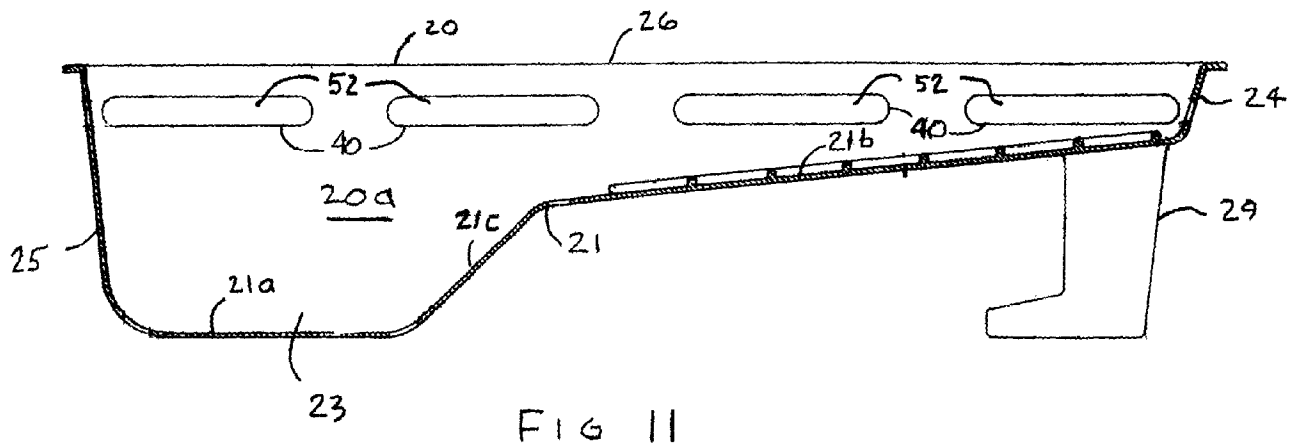
FIG. 11 is a cross-sectional side elevational view similar to FIG. 5, but with adhesive backed tape secured thereon over the openings in the paint tray.
Figure 12:
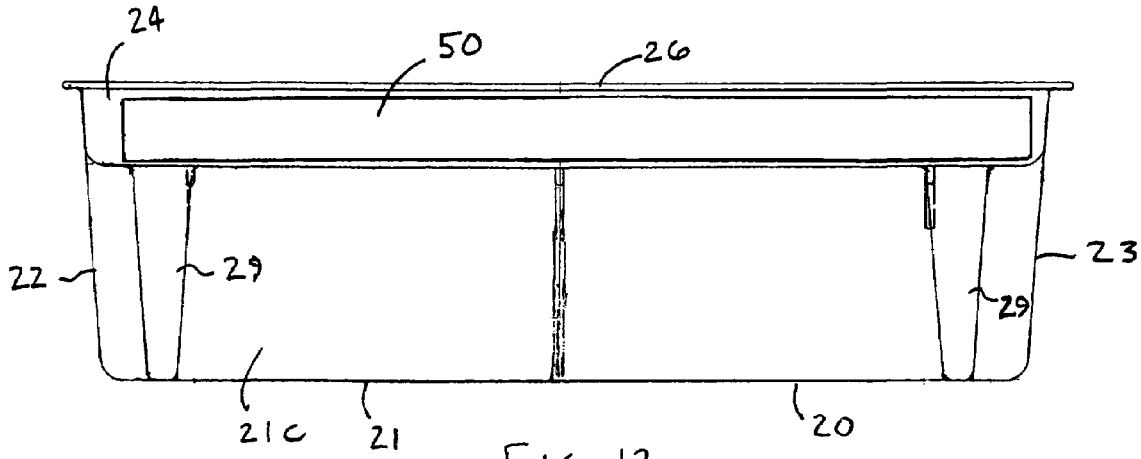
FIG. 12 is an end elevational view similar to FIG. 6, but with adhesive backed tape secured thereon over the openings in the paint tray.
Figure 13:
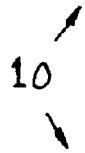
FIG. 13 is an end elevational view similar to FIG. 7, but with adhesive backed tape secured thereon over the openings in the paint tray.
Figure 13:
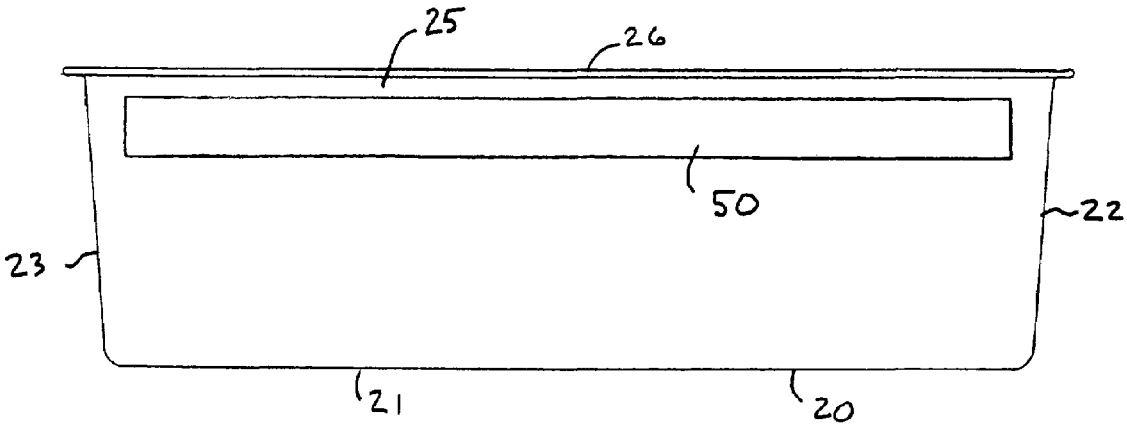
Figure 14:
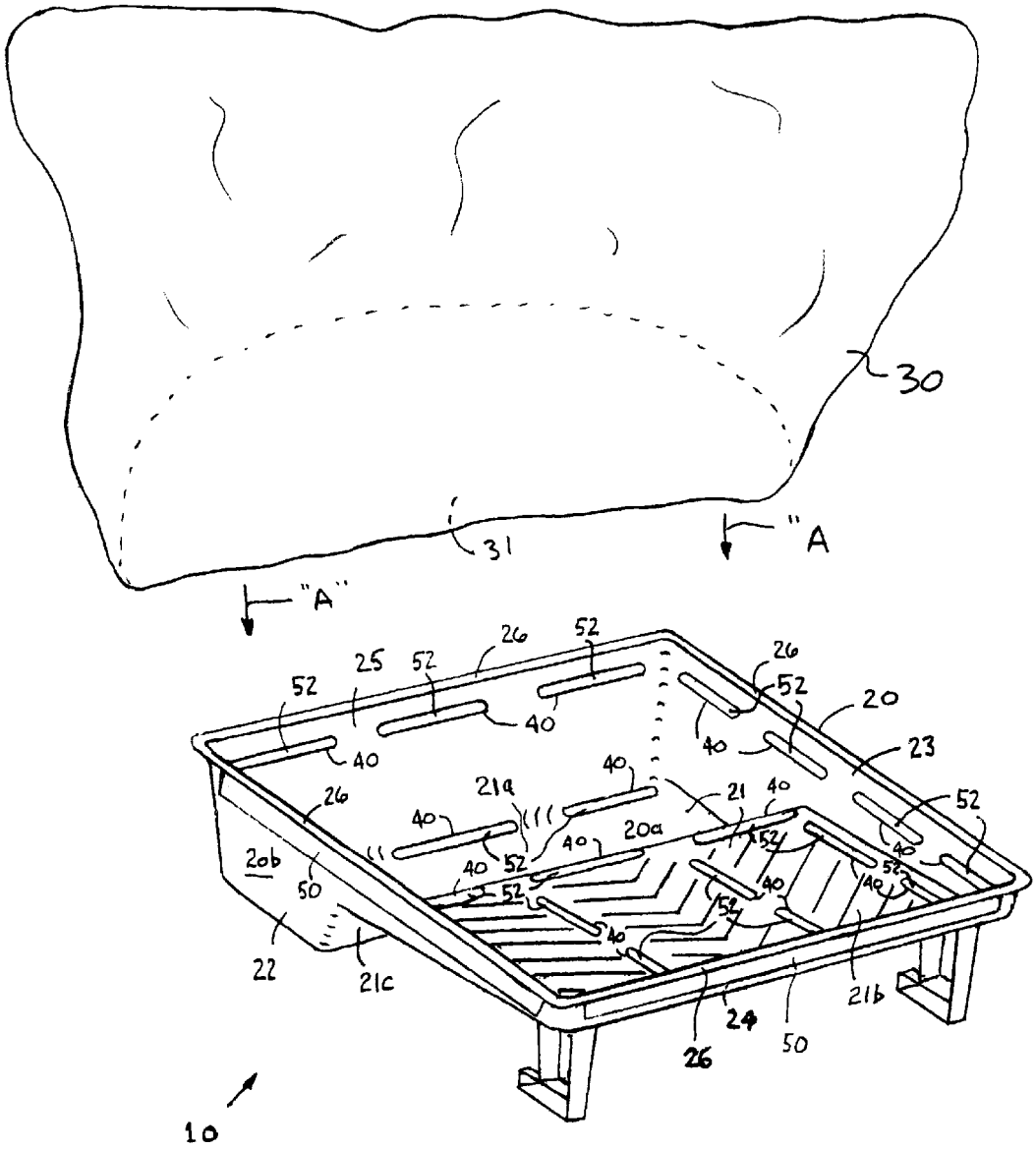
FIG. 14 is a perspective view similar to FIG. 8, but with a plastic tray liner bag about to be placed over the paint tray.
Figure 15:
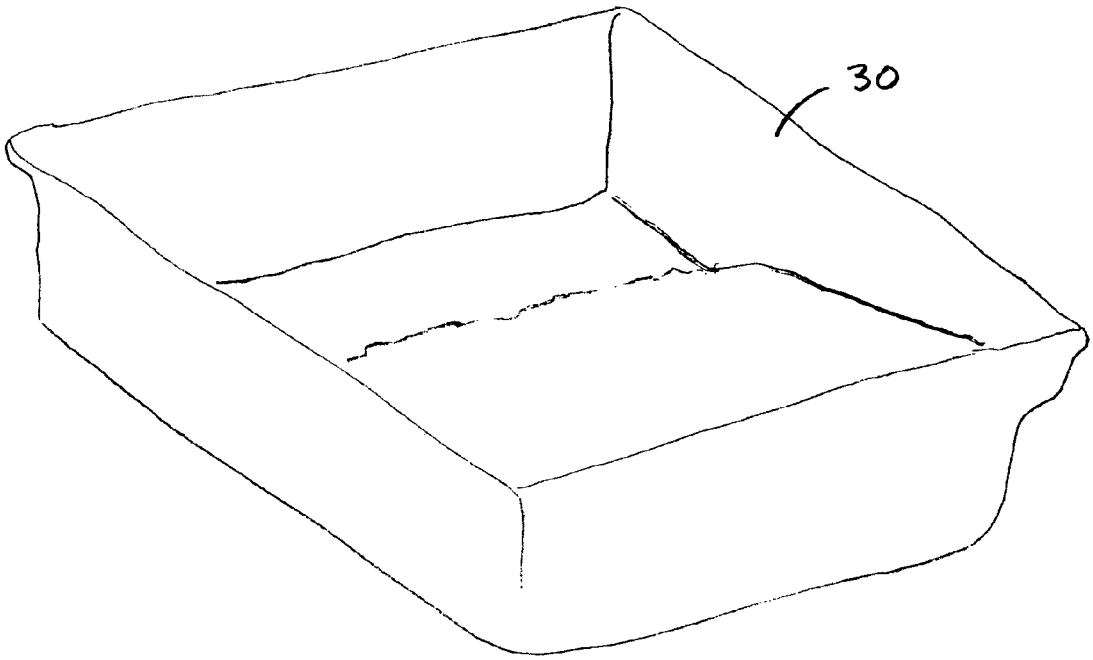
FIG. 15 is a perspective view similar to FIG. 14, but with the tray liner bag in place on the paint tray and pressed down so as to adhere to the adhesive back tape on the paint tray; and, FIG. 16 is a perspective view of a second preferred embodiment of the present invention.
Figure 16:
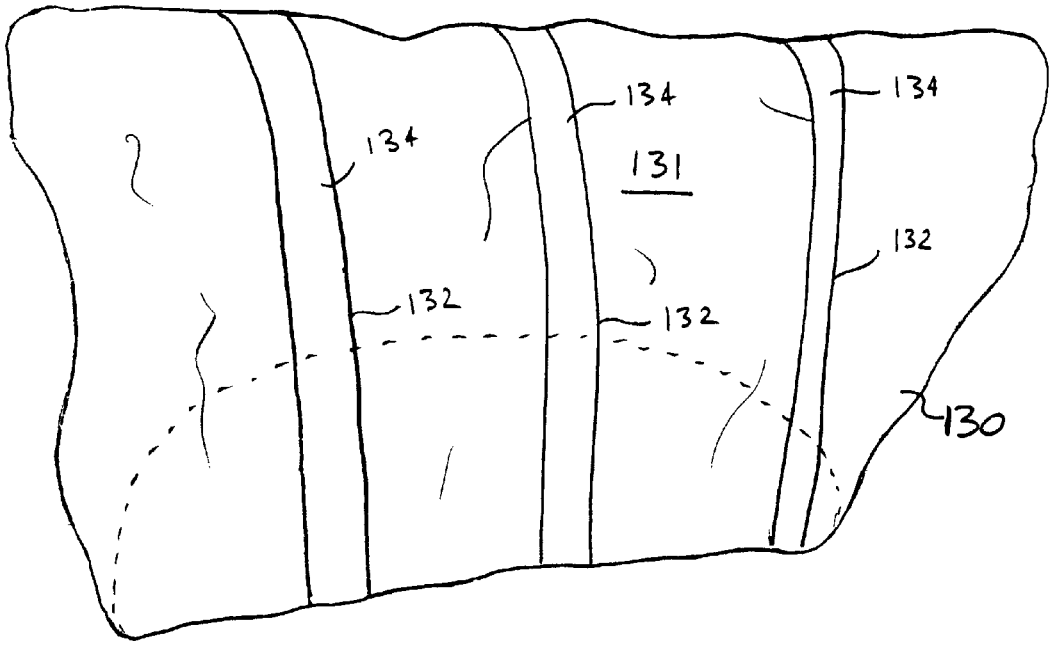

Referring to FIGS. 1 through 16 of the drawings, it will be noted that FIGS. 1 through 15 illustrate a first preferred embodiment of the paint tray of the present invention, and FIG. 16 illustrates a second preferred embodiment of the paint tray of the present invention.

Reference will now be made to FIGS. 1 through 15, which show the first preferred embodiment of the paint tray, as indicated by the general reference numeral 10. In its broadest sense, the first preferred embodiment paint tray 10 comprises a main body member 20 and paint tray liner bag 30.

As can be best seen in FIGS. 1 through 7, the main body member 20 of the paint tray 10 has substantially the same overall shape as a conventional paint tray. It is preferably made from either plastic or lightweight metal, such as aluminum. The main body member 20 has an interior surface 20*a* and an exterior surface 20*b*. In the first preferred embodiment, as illustrated, the main body member 20 includes a bottom floor 21, a right side wall 22, a left side wall 23, a pan end wall 24, and a reservoir end wall 25. The right side wall 22, the left side wall 23, the pan end wall 24 and the reservoir end wall 25 each extend upwardly from the bottom floor 21 to terminate in an upper edge 26. The bottom floor 21 comprises a lower portion 21*a* and sloped upper portion 21*b* interconnected by a ramp portion 21*c*. The paint tray 10 further comprises at least one leg member, and in the preferred embodiment as illustrated, left and right leg members 29, disposed adjacent the pan end wall 24.

However, in contrast to the prior art, the main body member 20 has a plurality of slot shaped apertures 40 disposed therein, in at least one of the bottom floor 21, the right side wall 22, the left side wall 23, the pan end wall 24, and the reservoir end wall 25. In the preferred embodiment as illustrated, there are slot shaped apertures 40 disposed in each of the bottom floor 21, the right side wall 22, the left side wall 23, the pan end wall 24, and the reservoir end wall 25. As can be seen in the Figures, there are groups of slot shaped apertures 40 that are longitudinally aligned with each other, in various parts of the main body member 20. More specifically, there are four groups of two longitudinally aligned slot shaped apertures 40 each and one group of three longitudinally aligned slot shaped apertures 40 in the sloped upper portion 21*b* of the bottom floor 21, one group of three longitudinally aligned slot shaped apertures 40 in the ramp portion 21*c* of the bottom floor 21 adjacent the lower portion 21*a*, one group of three longitudinally aligned slot shaped apertures 40 in the lower portion 21*a* of the bottom floor 21, one group of four longitudinally aligned slot shaped apertures 40 in the right side wall 22, one group of four longitudinally aligned slot shaped apertures 40 in the left side wall 23, one group of three longitudinally aligned slot shaped apertures 40 in the pan end wall 24, and one group of three longitudinally aligned slot shaped apertures 40 in the reservoir end wall 25. Such longitudinal alignment of the slot shaped apertures 40 permits maximum exposure of the adhesive surface 52 of the tape 50 to the interior surface 20*a* of the main body member 20.

In use, an adhesive back tape 50, such as masking tape, is adhered to the exterior surface 20*b* of the main body member 20 of the paint tray 10 along the slot shaped apertures 40, as can be best seen in FIGS. 8 through 13. The adhesive surface 52 of the tape 50 faces the interior of the paint tray 10, and can be contacted from the interior of the paint tray 10, as permitted by the slot shaped apertures 40.

Also in use, the thin and pliable paint tray liner bag 30 having a mouth 31 is placed over the main body member 20, as indicated by arrows "A", and then onto the main body member 20 at the interior surface 20*a* of each of the bottom floor 21, the right side wall 22, the left side wall 23, the pan end wall 24 and the reservoir end wall 25, as can be best seen in FIG. 15. The paint tray liner bag 30 is pressed down such that it adheres to the adhesive surface 52 of the tape 50 at the plurality of slot shaped apertures 40, thus causing the paint tray liner bag 30 to essentially take the shape of the main body member 20, as can be best seen in FIG. 15. Further, the paint tray liner bag 30 is precluded from moving around, when a paint roller is "picking up" paint from the paint tray 10.

When the paint in the paint tray 10, as held by the paint tray liner bag 30, is no longer required, the paint tray liner bag 30 can be carefully removed from the paint tray 10 so as to carry the excess paint with it. The excess paint in the paint tray liner bag 30 can be poured back into the paint can. Subsequently, the paint tray liner bag 30 can be disposed of through proper recycling channels for chemicals.

The tray liner bag 30 can be made from a thin plastic polymer sheet material, and may perhaps be a grocery bag, or the like, or alternatively can be made from a treated paper material. Also alternatively, a liner that is substantially a sheet and does not have the shape of a bag can be used.

It is also envisioned that the tray liner bag could be used as a promotional product, such as by beverage companies, to promote their products in conjunction with painting.

In an alternative embodiment, it is contemplated that a paint tray that uses the paint tray liner bag 30 could be made from cardboard, and could be sold in a flat configuration, which minimizes shipping space. For use, the flat cardboard paint tray would be folded into a three-dimensional in-use configuration.

In a second preferred embodiment of the present invention, as shown in FIG. 16, a pre-adhesived tray liner bag, as indicated by the general reference numeral 100, is contemplated. The pre-adhesived tray liner bag 130 of the present invention comprises a tray liner bag 130 made from a thin plastic polymer sheet material, with an adhesive backed tape 132 disposed on the outer surface 131 that is to contact the interior upwardly facing surface of the paint tray (not shown). As shown in FIG. 16, the tray liner bag 130 has strips of double-sided tape 132 on the outer surface 131 thereof. A layer of release paper 134 is adhered to the outer surface of the double-sided tape 132. In order to install the tray liner bag 130 onto a paint tray for use, the release paper 134 is removed from the double sided tape 132 and the tray liner bag 130 is turned over such that the double-sided tape 132 faces the paint tray. The tray liner bag 130 is then placed over the paint tray and pressed down onto the interior upwardly facing surface of the paint tray. Either the paint tray as taught herein or a conventional paint tray can be used.

Also, if desired, adhesive backed tape could be placed on the opposite facing surface of the bag (as considered when it is in place on a paint tray) in order to adhere the tray liner bag to the bottom surface of the paint tray, in order to secure the bag even more fully.

As can be understood from the above description and from the accompanying drawings, the present invention provides a paint tray that does not need cleaning, wherein it is easy to return excess paint to a paint can, and that does not interfere with a paint roller, all of which features are unknown in the prior art.

Other variations of the above principles will be apparent to those who are knowledgeable in the field of the invention, and such variations are considered to be within the scope of the present invention. Further, other modifications and alterations may be used in the implementation of the present invention without departing from the spirit and scope of the invention.

I claim:

1. A paint tray comprising:

a main body member having an interior surface and an exterior surface, and including a bottom floor, a right side wall, a left side wall, a pan end wall, and a reservoir end wall, wherein said right side wall, said left side wall, said pan end wall and said reservoir end wall each extend upwardly from said bottom floor to terminate in an upper edge; and, a plurality of apertures disposed in at least one of said bottom floor, said right side wall, said left side wall, said pan end wall and said reservoir end wall;

tape having at least one adhesive surface adhered to the exterior surface of said main body member at said plurality of apertures; and, a thin liner placed onto said main body member at the interior surface of each of said bottom floor, said right side wall, said left side wall, said pan end wall and said reservoir end wall, so as to adhere to said adhesive surface of said tape at said plurality of apertures.

2. The paint tray of claim 1, wherein said plurality of apertures are disposed in said bottom floor.

3. The paint tray of claim 1, wherein said plurality of apertures are disposed in said right side wall.

4. The paint tray of claim 1, wherein said plurality of apertures are disposed in said left side wall.

5. The paint tray of claim 1, wherein said plurality of apertures are disposed in said reservoir end wall.

6. The paint tray of claim 1, wherein said plurality of apertures are disposed in said pan end wall.

7. The paint tray of claim 1, wherein said bottom floor comprises a lower portion and sloped upper portion interconnected by a ramp portion.

8. The paint tray of claim 7, wherein said paint tray further comprises at least one leg member disposed adjacent said pan end wall.

9. The paint tray of claim 1, wherein said liner is thin and pliable.

10. The paint tray of claim 9, wherein said liner is made from plastic polymer sheet.

11. The paint tray of claim 10, wherein said liner comprises a liner bag.

12. The paint tray of claim 1, wherein said apertures comprise slot shaped apertures.

13. The paint tray of claim 1, wherein a portion of said slot shaped apertures are longitudinally aligned in said bottom floor.

14. The paint tray of claim 1, wherein a portion of said slot shaped apertures are longitudinally aligned in said right side wall.

15. The paint tray of claim 1, wherein a portion of said slot shaped apertures are longitudinally aligned in said left side wall.

16. The paint tray of claim 1, wherein a portion of said slot shaped apertures are longitudinally aligned in said pan end wall.

17. The paint tray of claim 1, wherein a portion of said slot shaped apertures are longitudinally aligned in said reservoir end wall.

18. A method of preparing a paint tray to accept paint for subsequent use, said method comprising the steps of:

providing a paint tray having a plurality of apertures disposed in at least one of said bottom floor, said right side wall, said left side wall, said pan end wall, and said reservoir end wall therein;

adhering tape having at least one adhesive surface to the exterior surface of said paint tray at said plurality of apertures; and, placing a thin liner onto said main body member at the interior surface of each of said bottom floor, said right side wall, said left side wall, said pan end wall and said reservoir end wall, so as to adhere to said adhesive surface of said tape at said plurality of apertures.

* * * * *